United States Patent [19]

Goettl

[11] Patent Number: 4,657,709

[45] Date of Patent: Apr. 14, 1987

[54] WATER DISTRIBUTION TROUGH FOR EVAPORATIVE COOLER PAD

[76] Inventor: Adam D. Goettl, 4960 E. Palomino Rd., Phoenix, Ariz. 85018

[21] Appl. No.: 792,843

[22] Filed: Oct. 30, 1985

[51] Int. Cl.[4] ..... B01F 3/04

[52] U.S. Cl. ..... 261/3; 62/310; 239/193; 239/379; 239/556; 261/106; 261/DIG. 3

[58] Field of Search ..... 261/106, 103, 110, 97, 261/111, 113, DIG. 3, DIG. 41, DIG. 44, 2–4; 62/310, 314, 315; 239/193, 379, 556, 553.5

[56] References Cited

U.S. PATENT DOCUMENTS

| | | | |
|---|---|---|---|
| 1,092,334 | 4/1914 | Burhorn | 261/110 X |
| 1,750,047 | 3/1930 | Metzger | 261/103 |
| 1,987,097 | 1/1935 | Coubrough | 239/193 X |
| 2,670,941 | 3/1954 | Feinberg | 261/97 X |
| 3,075,750 | 1/1963 | Goettl | 261/108 X |
| 3,092,096 | 6/1963 | Nett et al. | 261/103 X |
| 3,101,383 | 8/1963 | Paris | 261/103 X |
| 3,171,401 | 3/1965 | McDuffee | 261/97 X |
| 4,032,604 | 6/1977 | Parkinson et al. | 261/111 |
| 4,499,030 | 2/1985 | Stewart | 261/106 X |
| 4,579,692 | 4/1986 | Bugler, III et al. | 261/DIG. 44 |

*Primary Examiner*—Richard L. Chiesa

*Attorney, Agent, or Firm*—Herbert E. Haynes, Jr.

[57] ABSTRACT

Improved water distribution troughs are disclosed for use in the cooler pad assemblies of evaporative coolers. The troughs are provided with a primary channel and at least one secondary channel both of which are coextensive in a side-by-side relationship longitudinally of the trough and both are provided with multiple water outlets. The coextending plural channels provided in the troughs results in improved water distribution capabilities so that they can be used to overcome the water distribution problems of the large cooler pad assemblies used in industrial size evaporative coolers. The troughs can also be used in the relatively small pad assemblies of residential size evaporative coolers with such use providing overflow protection in the event of restricted water outlet flow resulting from mineral deposition and the like.

12 Claims, 11 Drawing Figures

WATER DISTRIBUTION TROUGH FOR EVAPORATIVE COOLER PAD

BACKGROUND OF THE INVENTION

1. Field of the Invention

This invention relates in general to evaporative coolers and more particularly to improved trough structures for distributing water to the cooler pads used in evaporative coolers.

2. Description of the Prior Art

Evaporative cooler structures have long been used primarily in hot relatively dry climates, to provide a low cost way of cooling both residential and commercial buildings.

Evaporative coolers have traditionally been in the form of box-shaped cabinets having open sides in which wettable cooler pads are demountably carried. An air handler mechanism, usually in the form of a centrifugal blower, is mounted within the cabinet and is operated to exhaust air therefrom. This creates a negative static pressure within the cabinet which causes hot ambient air to move through the wettable cooler pads into the cabinet and subsequently to be exhausted therefrom by the air handler mechanism. The air moving through the wettable cooler pads is cooled by the well known evaporation principle and this cooled air is supplied by the air handler to a point of use, such as by means of suitable ducting network.

In addition to the above described air moving sub-system, evaporative coolers all include a water supply sub-system and in most cases, this sub-system has a water recirculation capability. In a typical evaporative cooler, the bottom of the cabinet is in the form of a pan for containment of a water supply used in operating the cooler. A float controlled water shutoff valve is mounted in the floor plan and is coupled to a source of water such as a municipal water supply line. The float controlled water shutoff valve will operate to initially supply water to the floor pan and is intermittently opened, under control of the float, to supply make-up water to replace that lost as a result of the evaporation process.

A suitable pump is mounted in the floor plan of the evaporative cooler and is operated to supply water through a suitable plumbing network to the top of each of the wettable cooler pads. The water provided to the tops of the cooler pads is caught in a water distribution trough which forms the upper part of the pad frame in which a suitable wettable medium, such as excelsior, is contained. The water distribution trough distributes the water along the top of the wettable medium so that it flows downwardly under the influence of gravity through the medium and thereby comes in contact with the air being drawn into the cabinet through the medium. Such air and water contact causes the evaporation needed to cool the air and this, of course, causes the above mentioned loss of water. The water which is not lost to evaporation will drop from the bottom of the cooler pads into the floor pan for recirculation by the pump.

Traditionally, the prior art water distribution troughs are elongated sheet metal structures defining a single V-shaped in cross section channel extending longitudinally thereof, with a plurality of teardrop-shaped water outlet slits formed in spaced apart increments along the length of the channel. The slits are located in one of the walls which define the V-shaped cross sectional channel with the lower open ends of the slits being spaced upwardly from the bottom of the channel.

The movement of air through the wet cooler pads will deflect the water from a natural vertical flow down through the pads into one which causes the water to move toward the air outlet face as it nears the bottom of the pads. In most evaporative coolers of what are considered as being of a residential size, deflected water movement does not cause a problem. However, in evaporative coolers of the type commonly referred to as industrial size coolers, water deflection will prevent the water from reaching the lower ends of the pads due to the increased height of the cooler pads used in industrial size coolers.

To alleviate the water deflection problem, it is a common practice of manufacturers of such industrial size coolers to employ a second trough at a point intermediate top and bottom of the cooler pads to catch the water as it nears the air outlet face and direct it back into the middle of the pads. The second or lower, trough cannot be attached to the cooler pad frame in the same manner as the top trough and thus must be of a different configuration. This increases the tooling costs in addition to the costs for the trough itself and the additional manufacturing time and labor.

During operation of the evaporative cooler, the water, which inherently contains minerals, such as sodium and calcium chlorides and other impurities, will increase as to the concentration of those minerals and other impurities as a direct result of evaporation. As the mineral concentration increases, the rate of precipitation will also increase, and this results in mineral deposition, or scaling, of virtually every component of the evaporative cooler, and this problem is of particular concern in all the parts of the cooler having direct contact with the water.

In addition to the mineral build-up and resulting scaling problem, other contaminants will collect in the water supply as a result of the air washing effect which occurs when the air comes into contact with the water in the cooler pads. A relatively large quantity of contaminants, such as airborne dust, pollen, and the like, will be washed out of the ambient air as it passes through the wet cooler pads, and those contaminants are carried throughout the cooler by the recirculating water supply.

One area of evaporative coolers which is effected by the mineral build-up and other contamination problems in evaporative coolers is the water distribution trough. Mineral deposition will occur particularly in the immediate area of the water outlet slits and will gradually reduce the size of the outlets and thus reduce the water flow therethrough. As the size of the water outlet slits is reduced, other contaminating materials, such as the above mentioned pollen, dust, and the like, will tend to become caught in the outlet slits thus reducing water flow therethrough. When this begins to occur, the wettable medium will develop dry spots which has a detrimental effect on the cooling efficiency of the evaporative cooler. As the outlet slits becomes progressively smaller, the outlet flow rate of the troughs will become less than the input flow rate of the water received from the cooler's plumbing system and overflowing can result.

Due to the prior art pad frame and water distribution trough configurations, no provision is made to allow a single top mounted water distribution trough to be used in all the cooler pad assemblies of various sizes of evaporative coolers. And, the prior art water distribution troughs make no provisions for handling water outlet clogging problems and the overflow problem.

Therefore, a need exists for a new and improved water distribution trough for use in the evaporative cooler pad assemblies of evaporative coolers.

SUMMARY OF THE INVENTION

In accordance with the present invention, new and improved water distribution troughs are disclosed for use in the cooler pad assemblies used in evaporative coolers. The distribution troughs may be of various configurations but all have a primary channel and at least one secondary channel which coextend in side-by-side relationship along the length of the distribution troughs, and water outlet means are provided in the primary and secondary channels to enable the distribution troughs to accomplish normal and special purpose water distribution functions.

In a first configuration of the new and improved water distribution troughs of the present invention, both the primary channel and the single secondary channel are of V-shaped cross section. The primary channel is located above and proximate the air outlet face of the pad assembly, e.g. the face which faces in to the cabinet, and the secondary channel is located above and proximate the air inlet face of the pad assembly. A plurality of water outlet means are provided in spaced apart increments in single rows along the bottoms of both the primary and the secondary channels. The primary channel is configured to locate its outlet means approximately at the transverse center above the pad medium and the secondary channel is disposed so that its outlet means are between the transverse center and the air inlet face of the pad assembly above the pad medium.

In a second embodiment of the water distribution troughs of the present invention, both the primary and the secondary channels are of truncated V-shaped cross section to provide a flat bottom surface in each of those channels. A plurality of water outlet means are provided in multiple rows in the bottom surfaces of both the primary and the secondary channels. The bottom surface of the primary channel is located approximately above the transverse center of the pad medium and the bottom of the secondary channel is offset toward the air inlet face of the cooler pad assembly.

In a third embodiment, the trough of the present invention has the primary channel and at least a pair of secondary channels, all of which are in a coextensive side-by-side relationship. The primary and both of the secondary channels are of V-shaped cross section and each is provided with a single row of water outlet means in spaced increments along their respective bottoms. The water outlet means of the primary channel are disposed above and at the approximate transverse center of the wettable pad medium. The water outlet means of the two secondary channels are located between the transverse center of the pad assembly and the air inlet face thereof.

The water outlet means mentioned above as being provided in the various embodiments of the water distribution troughs of the present invention may be configured in various ways all of which are designed to reduce clogging of the openings as a result of mineral deposition, or scaling, in the areas of the outlet means.

In a first configuration of the water outlet means, the openings are punched, or otherwise formed, in the channels so that the material of which the trough is made is torn, or ruptured, rather than being removed. The punching, or other opening forming operation, is accomplished from a direction which locates the jagged edges of the ruptured material so that the edges depend from and surround the lower end of the outlet openings. In this manner, water emerging from the channels will flow through the openings and drip or run off of the depending jagged edges. This will result in the upper parts of the openings being continuously washed by the flowing water and mineral depositions being localized for the most part at the depending jagged edges.

A second configuration of water outlet means which may be used in the water distribution troughs of the present invention include outlet openings which are punched or otherwise formed in the same manner as the above described first configuration. However, these openings are formed centrally through dimples which are formed so as to be upstanding in the bottom of the channels. In that the upper ends of the openings are elevated relative to the bottom of the channels, a sediment trap is provided in the channels wherein the relatively heavy contaminating particles will settle and thus be kept from blocking the outlet openings.

In a third configuration of the water outlet means, holes are punched or otherwise formed in the channels and a tubular member is pressed into each of the openings. The tubular members are disposed so that their upper ends are elevated relative to the bottom of the channels so as to provided the above described sediment trap. The lower, or outlet ends of the tubular members extend below the channels and surround the lower openings so as to localize scaling much in the same manner as the depending jagged edges of the openings described above.

One of the more important objectives of the present invention is to provide a standardized water distribution trough configuration which allows it to be used in all cooler pad assemblies regardless of the size of the evaporative cooler in which they are to be used with the standardized trough solving the prior art water deflection problem that is primarily associated with industrial size coolers.

In relatively small evaporative coolers of the types referred to as residential size coolers, pumps of predetermined size are used to deliver a quantity of water which is within the water handling capabilities of the primary channels of the toughs of the cooler pad assemblies used in this size coolers. In that the cooler pad assemblies used in residential coolers have a relatively small height dimension, water deflection is usually not a problem in such coolers.

In the relatively larger industrial size coolers, larger pumps are used to supply more water to the larger cooler pad assemblies thereof. The increased amount of water is intentionally beyond the water handling capabilities of the primary channels and a predetermined amount will overflow the primary channels into the secondary channels. As described above, the water outlet means of the primary channels are approximately centered transversely over the wettable pad medium and therefore will properly wet the upper parts of the pad medium. In that the water outlet means of the secondary channels are proximate the air inlet faces of the pad assemblies, the water distributed by the secondary channels will start its downward movement at the air inlet face of the wettable pad medium and will be deflected toward the transverse center of the medium as it moves downwardly therethrough. In this manner, the water distributed by the secondary channels will wet the lower parts of the cooler pad mediums without reaching the air outlet faces thereof.

When the water distribution troughs are used in the cooler pad assemblies of the relatively small residential evaporative coolers, the secondary channel or channels thereof, as described above, are not usually needed to overcome the water flow deflection problem. In such cases, the secondary channel or channels will handle unintentional overflow from the primary channel in the event of clogging or other restriction of the water outlet flow rate of the primary channel. Also, in such cases, the secondary channel or channels can be used to improve transverse water distribution in cooler pads having larger than normal thickness dimensions.

Accordingly, it is an object of the present invention to provide new and improved water distribution troughs for use with the cooler pad assemblies of evaporative coolers.

Another object of the present invention is to provide a new and improved water distribution troughs for use in the cooler pad assemblies of evaporative coolers with the distribution troughs being configured so that a single top mounted trough can be used in the variously sized cooler pad assemblies of variously sized evaporative coolers.

Another object of the present invention is to provide new and improved water distribution troughs which can be used at the tops of the cooler pad assemblies which are used in industrial size evaporative coolers with the troughs overcoming the water deflection problem which is inherent in such pad assemblies due to the height thereof.

Another object of the present invention is to provide new and improved water distributing troughs for use in the cooler pad assemblies evaporative coolers with the distribution troughs being configured to provide improved water distribution capabilities and to resist outlet opening blockage as a result of mineral deposition or sediment blockage.

Another object of the present invention is to provide new and improved water distribution troughs of the above described character which includes a primary channel and at least one secondary channel which extend longitudinally of the trough in a side-by-side relationship with the channels being provided with plural water outlet means formed in spaced increments therein.

Still another object of the present invention is to provide new and improved water distribution troughs of the above described character wherein the water outlet means provided in the channels of the troughs are of various special configurations which resist mineral deposition in the immediate area of the outlet means and resist blockage by other contaminants.

The foregoing and other objects of the present invention as well as the invention itself, may be more fully understood from the following description when read in conjunction with the accompanying drawings.

DESCRIPTION OF THE PREFERRED EMBODIMENTS

Figure 1:
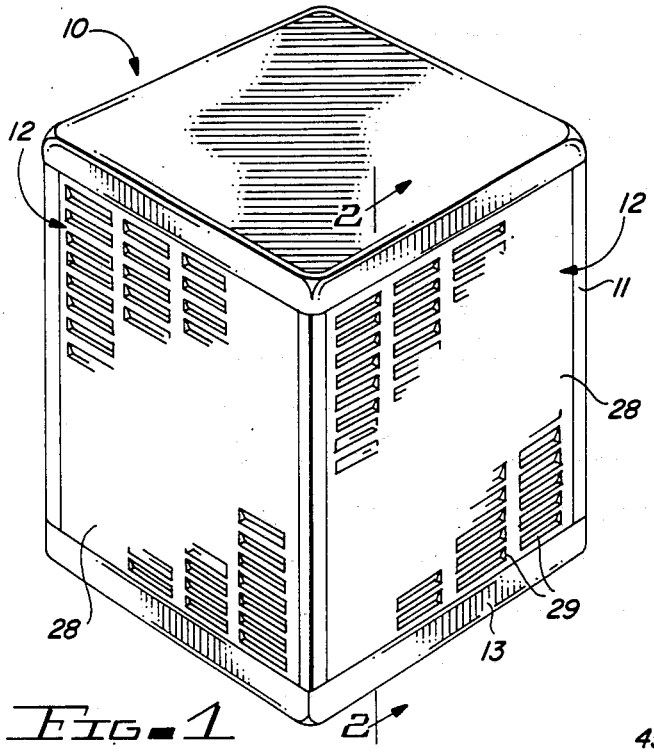
FIG. 1 is a perspective view of a typical evaporative cooler.
Figure 2:
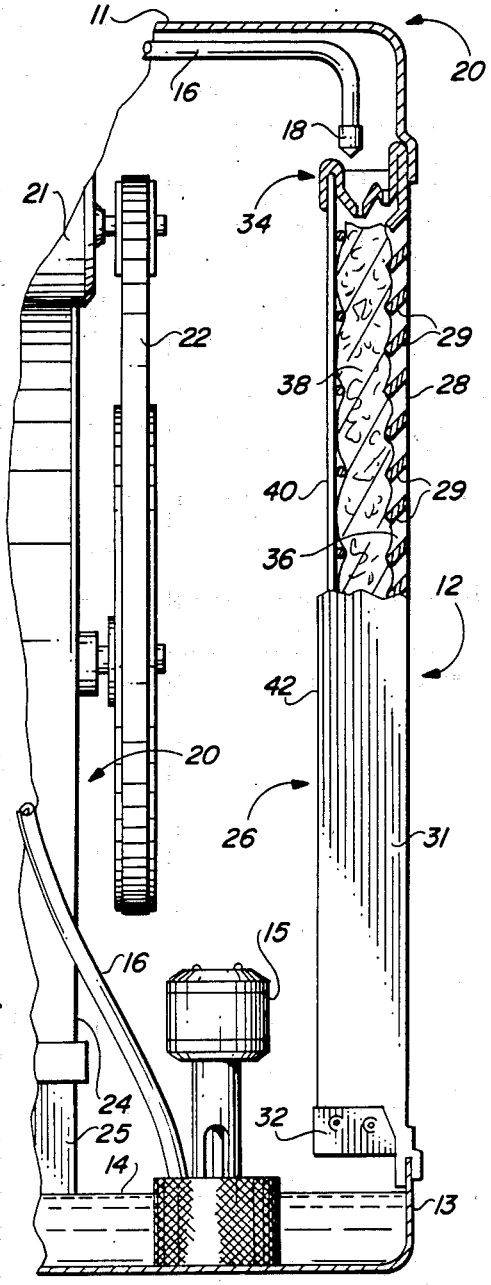
FIG. 2 is an enlarged fragmentary sectional view taken along the line 2—2 of FIG. 1.

Referring more particularly to the drawings, FIGS. 1 and 2 show a typical evaporative cooler 10 which will now be described briefly to insure a clear understanding of the present invention.

As seen best in FIG. 1, the evaporative cooler 10 includes a cabinet 11 of four sided configuration with a cooler pad assembly 12 being demountably carried in each of the sides of the cabinet. It is to be understood that some evaporative coolers are of different configuration and thus have different numbers of cooler pad assemblies. For example, one cooler type in common use is known in the art as a sidedraft cooler in which output air from the cooler is directed through one side of the cabinet and this type of cooler has three cooler pad assemblies. Another type of cooler is configured to use one cooler pad assembly and still another has a circular housing with a large circular pad assembly.

In any event, all coolers have an operating water supply which, in the illustrated typical evaporative cooler 10, is contained in the floor pan 13. The water supply which is indicated at 14 in FIG. 2, is supplied from a suitable source such as a municipal water supply, to the floor pan 13 through a float controlled shutoff valve (not shown) which maintains the water supply at a predetermined level in the floor pan. A suitable pump 15 is mounted in the floor pan and is operated to supply water under pump pressure to a plumbing sub-system 16 which directs the received water to a plurality of outlets 18 (one shown) that are located in the top of the cabinet 11 above each of the cooler pad assemblies 12. Water drops down from the plumbing system outlets 18 onto the tops of the pad assemblies for wetting thereof as will hereinafter be described in detail. The water flows downwardly through the pad assemblies 12 and the unevaporated water will drop from the pad assemblies into the water supply 14 for recirculation.

As seen in FIG. 2, an air handler mechanism such as the illustrated centrifugal blower 20 is mounted within the cooler's cabinet 11 and is operated by a suitable electric motor 21 and pulley-belt arrangement 22 to exhaust air from the cabinet through the outlet 24 of the blower. The illustrated cooler 10 is of the type known as a downdraft cooler and the outlet 24 of the blower 20 is connected to a suitable duct 25 which extends downwardly through the floor pan 13. When the cooler 10 is installed, usually on the roof of a building (not shown) the outlet duct 25 of the cooler 10 is usually coupled to a duct system (not shown) of the building for delivering the air exhausted from the cooler to a point or points of use within the building.

When the blower 20 is operated to exhaust air from the cooler's cabinet 11, it will create a negative static pressure within the cabinet and this, in turn, causes ambient air to flow through the cooler pad assemblies 12 into the cabinet. As the air moves through the pad assemblies, which are wetted in the above described manner, evaporation takes place and this lowers the sensible temperature of the air and this cooled air is delivered by the cooler to the above mentioned point or points of use.

Figure 3:
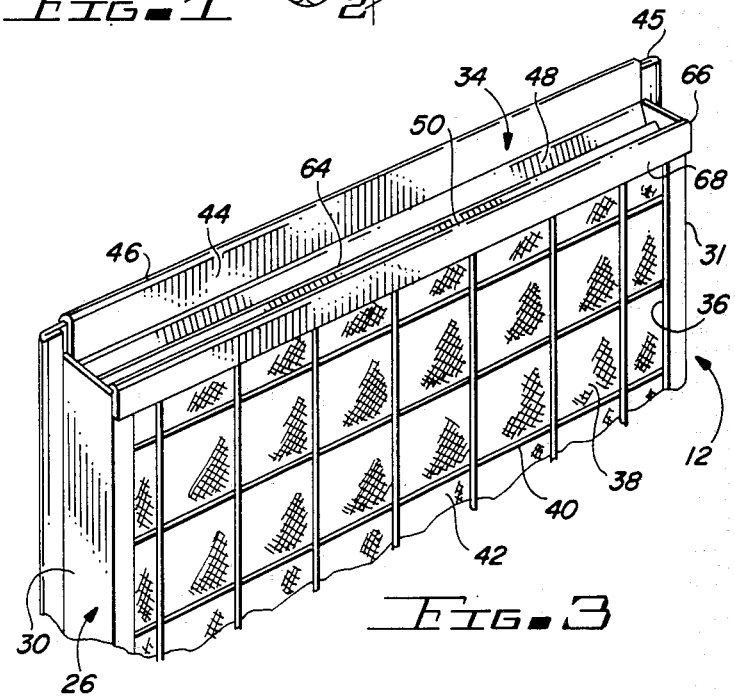
FIG. 3 is a fragmentary perspective view of a typical cooler pad assembly having a first embodiment of water distribution trough of the present invention mounted therein.
Figure 4:
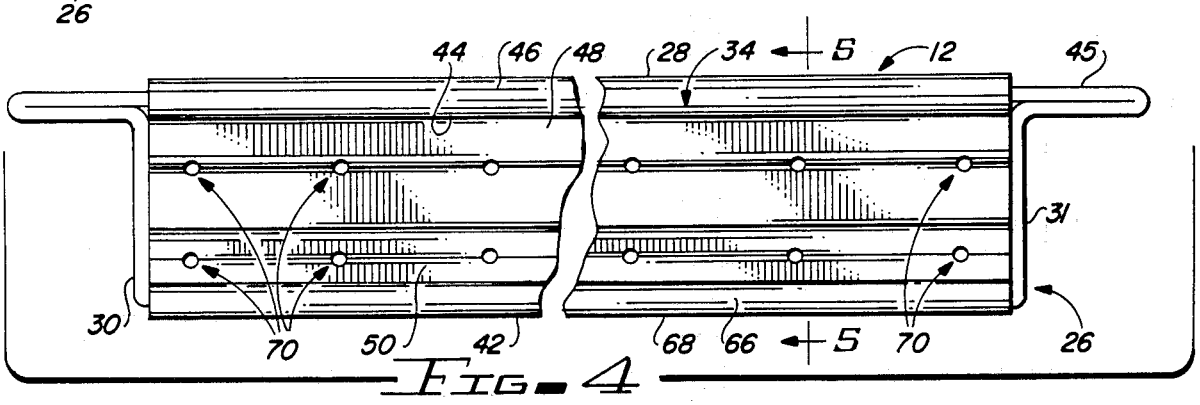
FIG. 4 is a top view of the water distribution trough shown in FIG. 3.

As shown in FIGS. 2, 3 and 4, a typical evaporative cooler pad assembly 12 includes a frame 26, usually formed of sheet metal, which has an air inlet face 28 in which a plurality of louvers 29 are stamped or otherwise formed. Channel-shaped side frame members 30 and 31, and a similarly shaped bottom frame member 32 (FIG. 2) are integral with the inlet face 28 and extend normally from the inlet face. The cooler pad frame 26 further includes a water distribution trough 34 which, in addition to its water distribution function, forms the top frame member of the frame 26. It will be understood that all cooler pad assemblies have a water distribution trough. However, the specific trough 34, and other embodiments thereof, as will hereinafter be described in detail, constitute the present invention.

The cooler pad frame 26 including the above described inlet face 28, side frame members 30 and 31, the bottom frame member 32 and the distribution trough 34 define a cavity 36 immediately behind the air inlet face 28. A wettable pad medium 38, such as excelsior, is demountably disposed within the cavity 36 of the pad frame 26 and is held in place within the cavity by a removable suitable wire grid 40. The wire grid 40 side of the evaporative cooler pad assembly 12 may be referred to as the air outlet face 42 of the pad assembly.

Figure 5:
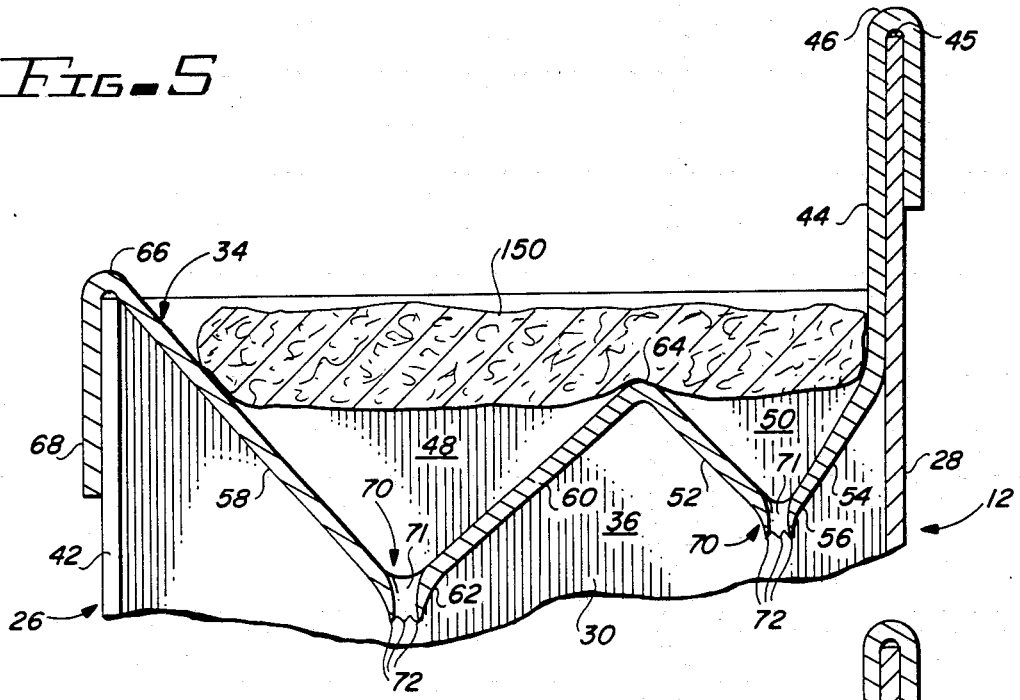
FIG. 5 is an enlarged sectional view taken along the line 5—5 of FIG. 4.

As seen best in FIGS. 3, 4 and 5, the water distribution trough 34 is an elongated structure which may be formed of sheet metal, molded from a suitable synthetic resin, or the like. The trough 34 has an upstanding front flange 44 which is attached to the upper end 45 of the inlet face 28 of the pad frame 2 in any suitable manner such as by being folded as at 46 and disposed so as to be in looped over engagement with the upper end 45 of the air inlet face 28. The trough 34 is folded, molded, or otherwise formed to provide a primary channel 48 and a similarly extending secondary channel 50 both of which extend longitudially of the trough in a side-by-side or coextensive relationship. Both the primary and secondary channels 48 and 50 are of V-shape cross sectional configuration with the primary channel 48 being disposed proximate the air outlet face 42 of the pad assembly 12 and the secondary channel 50 being proximate the air inlet face 28.

The secondary channel 50 of the trough 34 is defined by longitudinally extending sidewalls 52 and 54 which diverge upwardly from a longitudinally extending vertex 56. The sidewall 54 is an integrally formed extension of the above mentioned upstanding front flange 44 of the trough 34. The primary channel 48 of the trough 34 is similarly defined by longitudinally extending sidewalls 58 and 60 which diverge upwardly from a longitudinally extending vertex 62. The sidewall 60 of the primary channel 48 and the sidewall 52 of the seconary channel 50 are integral and cooperately form a longitudinally extending apex ridge 64 which separates the two channels. The other sidewall 58 of the primary channel 48 is bent over as at 66 to provide a longitudinally extending rear flange 68 which provides rigidification of the trough 34 and which has it opposite ends suitably connected to the side frame members 30 and 31 of pad frame 26 such as in the manner shown.

A plurality of water outlet means 70 are formed in spaced increments along the vertex 62 of the primary channel 48 and along the vertex 56 of the secondary channel 50. The water outlet means 70 are of special configuration as will hereinafter be described in detail.

As seen in FIG. 5, the primary channel 48 is considerably larger than the secondary channel 50 so as to locate its vertex 62, and thus its water outlet means 70 at approximately the transverse center of the pad assembly. By configuring the primary channel 48 in this manner, the vertex 56 of the secondary channel 50, and thus its outlet means 70 will be offset toward the air inlet face 28 of the cooler pad assembly.

The primary channel 48 is intended to be used to accomplish the usual water distribution function in the relatively small sizes of evaporative coolers which are commonly referred to as residential coolers. In other words, the water received in the trough 34 from the plumbing system outlets 18 will be received in the primary channel 48 and will exit therefrom through the water outlet means 70 thereof onto the top of the wettable pad medium 38. In the event that the water outlet means 70 of the primary channel 48 becomes restricted such as by mineral deposition, foreign matter contamination, or the like, the water received in the primary channel 48 will overflow the apex ridge 64 into the secondary channel 50 for continued water distribution purposes. (In addition to this particular special water handling function, the secondary channel provides the trough 34 with other advantages over prior art troughs. For example, if the evaporative cooler pad assembly 12 has a thickness dimension which is larger than normal, improved transverse water distribution can be accomplished by increasing the water input to the trough 34 beyond the water handling capability of the primary channel 48 so that it is intentionally caused to overflow into the secondary channel 50.

In addition to the use of the water distribution troughs 34 in the relatively small residential size coolers, as discussed above, they may be used in forming the cooler pad assemblies which are used in the relatively larger coolers which are sometimes referred to as industrial size coolers. The cooler pad assemblies used in industrial size coolers have a considerably increased height dimension in comparison to the pad assemblies used in residential size evaporative coolers. As a result of the increase height dimensions, the hereinbefore described water flow deflection toward the air outlet faces 42 of the pad assemblies will occur due to the air flow through the pads into the cooler cabinet 11. Industrial size coolers use larger pumps to supply an increased amount of water to the larger pads thereof; and the output flow rate of such pumps supplies more water to the troughs 34 than can be handled by the primary channels 48 thereof. Therefore, the excess water will intentionally be allowed to overflow into the secondary channels 50. The predetermined water handling capability of the two channels 48 and 50 will thus direct predetermined quantities of water to two separate locations along the tops of the pad mediums 38. The water distributed by the primary channels is directed to approximately the transverse centers of the mediums 38 for wetting the top portions thereof. Water flow deflection will, in most instances, not allow the water distributed by the primary troughs 48 to reach the lower parts of the pad mediums 38. In that the water outlet means 70 of the secondary channels 50 are offset toward the air inlet faces 42 of the pad assemblies, that water will reach the lower parts of the wettable mediums 38 even though it too will be deflected in its movement down through the pad assemblies.

As hereinbefore described, evaporative coolers in general are subject to chronic mineral deposition problems. The water outlet openings of the distribution trough are among the areas of an evaporative cooler which are effected by this problem in that mineral deposition can restrict and sometimes completely clog the outlets. The special water outlet means 70 are intended to minimize the effects of mineral deposition or other restriction thereof by foreign contaminants. The water outlet means 70 of both the primary and secondary channels 48 and 50 are punched or otherwise formed so as to tear, or rupture the material, rather than remove a part, or slug of the material. Such rupturing of the material will, of course, form apertures 71 and will leave jagged edge, as indicated at 72, and those edges surround and depend from the lower end of the apertures. As a result, water will flow freely through the apertures 71 and will follow the jagged edges 72 and thus be drawn more or less radially out of the lower ends of the apertures 71 and will fall from the jagged edges. In this manner, the free flowing of water will continuously wash the apertures 71 and mineral deposition will take place primarily at the jagged edges 72 rather than in the apertures.

Figure 6:
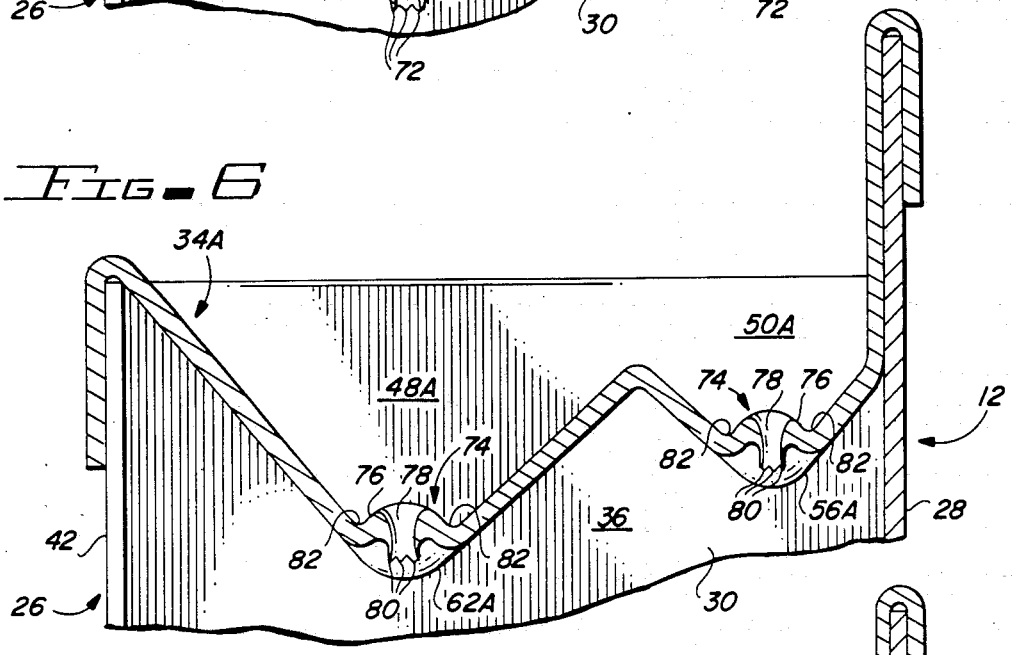
FIG. 6 is a view similar to FIG. 5 and showing a modification of the first embodiment of the water distribution trough of the present invention.

A modified form of water distribution trough 34A is shown in FIG. 6 with this trough 34A being identical to the above described trough 34 with the exception of the water outlet means which are identified by the reference numeral 74 in this modified trough 34A. At the locations in the primary and secondary channels 48A and 50A, respectively, of the trough 34A where each of the plurality of incrementally spaced outlet means 74 are formed, a substantially hemispherical dimple 76 is formed. The dimples 76 are formed so as to extend upwardly from the vertex 62A into the primary channel 48A and from the vertex 56A into the secondary channel 50A. In addition to the dimples 76, each of the water outlet means 74 includes an aperture 78 which is punched or otherwise formed in the crown of its dimple 76 in the manner hereinbefore described with reference to the outlet means 70. Therefore, the top water inlet end of each aperture 78 is located on top of its dimple and its lower water outlet end is surrounded by the depending jagged edges 80. By locating the upper inlet ends of the apertures above the bottoms 82 of the primary and secondary channels 48A and 59A, the bottoms of those channels become sediment traps. Relatively heavy foreign particles, such as flakes or pieces of precipitated minerals, sand, and the like, will settle in the trap areas 82 and thus be prevented from entering and possibly clogging the apertures 78.

Figure 7:
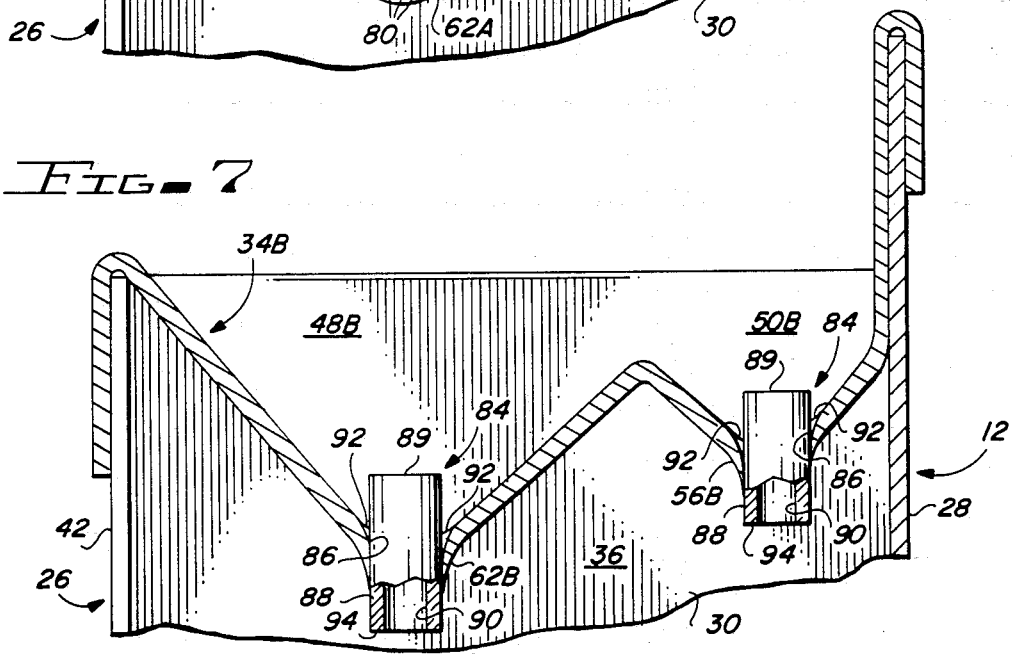
FIG. 7 is a view similar to FIGS. 5 and 6 and showing another modification of the first embodiment of the water distribution trough of the present invention.

Another modified form of water distribution trough 34B is shown in FIG. 7 with this trough being identical to the hereinbefore described distribution troughs 34 and 34A with the exception of the plural water outlet means 84. At each of the locations along the vertex 62B of the primary channel 48B and along the vertex 56B of the secondary channel 50B where one of the water outlet means 84 is provided, a relatively large hole 86 is punched or otherwise formed, and a relatively short length of tubing 88 extends through each of those holes. Each piece of tubing 88 is disposed in its respective one of the holes 86 so that the upper water inlet end 89 of its bore 90 is spaced above the bottom 92 of its respective one of the channels so that the bottoms 92 of the channels become sediment traps for the purpose described above. Also, each piece of the tubing extends below the vertex of its respective one of the channels 48B and 50B so that its water outlet end 94 depends therefrom. In that the depending outlet end 94 surrounds the bore 90 of the tubing 88, it will act much in the same manner as the jagged edges 72 of the above described water outlet means 70 (FIG. 5) to allow a free flow of water through the bore 90 and draw the water more or less radially away from the lower end of the bore 90.

The relative sizes of the tubing 88 and the holes 86 are such that the tubing is a snug fit but can be pushed out of the holes to facilitate periodic cleaning.

Figure 8:
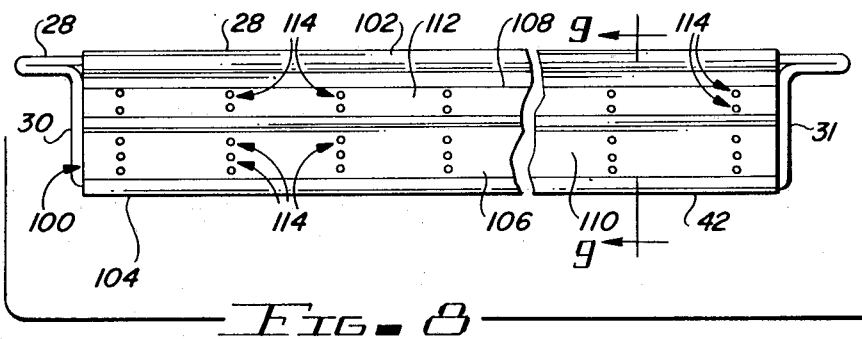
FIG. 8 is a top view of a second embodiment of the water distribution trough of the present invention.
Figure 9:
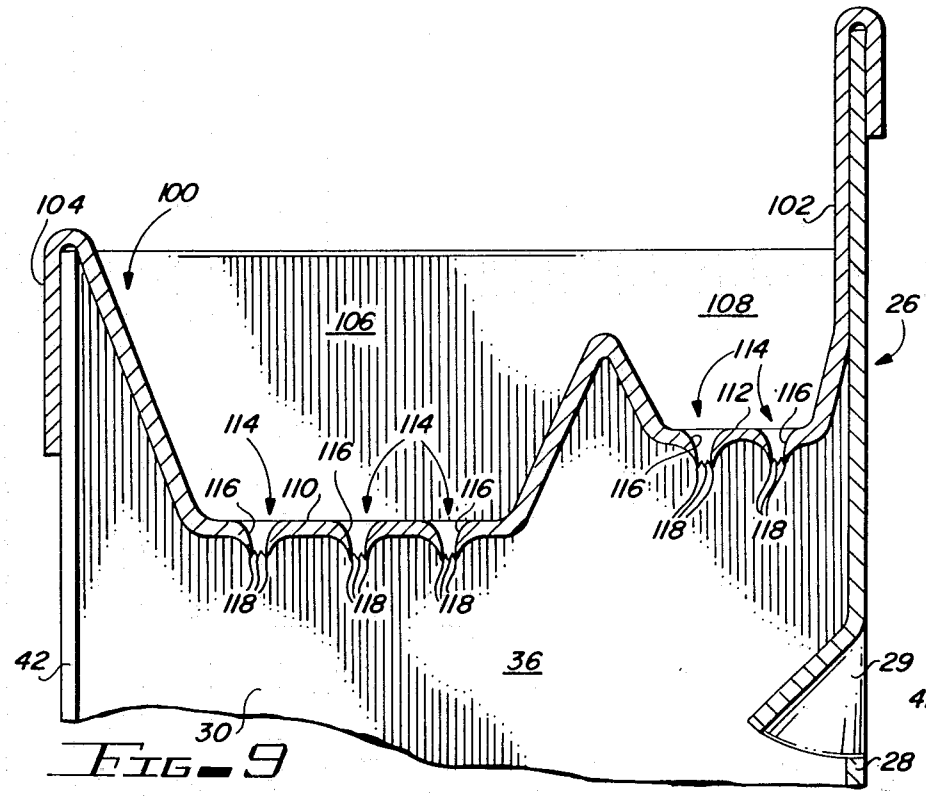
FIG. 9 is an enlarged sectional view taken along the line 9—9 of FIG. 8.

Reference is now made to FIGS. 8 and 9 wherein a second embodiment of the water distribution trough of the present invention is shown with this second trough embodiment being indicated in its entirety by the reference numeral 100.

The trough 100 is similar to the previously described trough 34 and thus has an upstanding front flange 102 which is suitably attached to the upper end of the inlet face 28 of the cooler pad frame 26, and a rear flange 104 which is attached to the side frame members 30 and 31 and is disposed proximate the air outlet face 42 of the pad assembly. The trough 100 is configured to define a relatively large primary channel 106 and a relatively smaller secondary channel 108 between the front and rear flanges 102 and 104 thereof. The two channels extend longitudinally of the trough in side-by-side, or coextensive relationship with the primary channel 106 being proximate the rear flange 104 and the secondary channel 108 being proximate the front flange 102.

The primary channel 106 is of truncated V-shape in cross section to provide a flat bottom surface 110 therein and the secondary channel 108 is similarly truncated to provide a flat bottom surface 112 therein.

A plurality of water outlet means 114 are formed in spaced increments in a plurality of longitudinally extending rows in the bottom surface 110 of the primary channel 106, and in a plurality of rows in the bottom surface 112 of the secondary channel 108. This arrangement of the water outlet means 114 provides improved transverse water distribution which is important particularly in cooler pad assemblies which have thickness dimensions which are larger than normal as well as in the hereinbefore described industrial size cooler pad assemblies.

As seen in FIG. 9, each of the illustrated water outlet means 114 is identical to the hereinbefore described water outlet means 70 (FIG. 5), and therefore includes an aperture 116 having depending jagged edges 118 which surround the lower water outlet end of the aperture.

It will be understood that water distribution trough 100 of this embodiment of the present invention could be provided with either of the above described water outlet means 74 (FIG. 6) or 84 (FIG. 7), instead of the illustrated outlet means 114.

Figure 10:
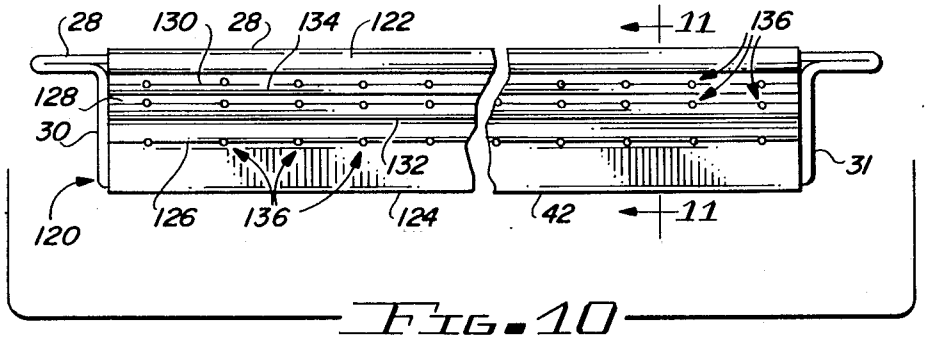
FIG. 10 is a top view of a third embodiment of the present invention.
Figure 11:
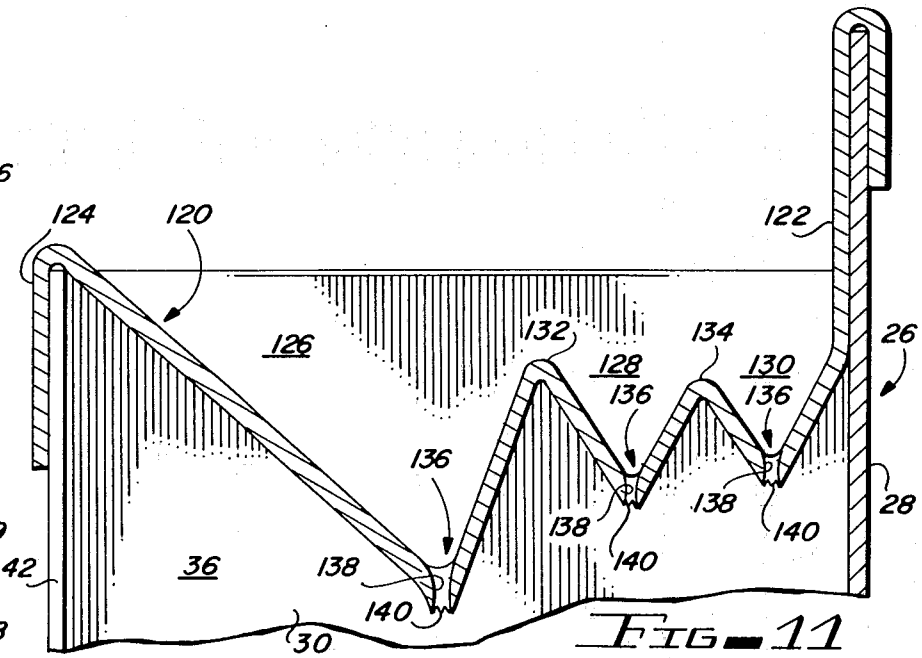
FIG. 11 is an enlarged sectional view taken along the line 11—11 of FIG. 10.

Reference is now made to FIGS. 10 and 11 wherein a third embodiment of the water distribution trough of the present invention is shown with this embodiment being indicated generally by the reference numeral 120.

The trough 120 is similar to the other embodiments discussed fully above and therefore includes the front flange 122 and the rear flange 124 which are mounted to the pad frame 26 in the manner previously described. The trough 120 is configured to define a relatively large primary channel 126 and at least a pair of progressively smaller secondary channels 128 and 130. All of the channels extend longitudinally of the trough in side-by-side coextensive relationship with the primary channel 126 being disposed proximate the rear flange 124, the first secondary channel 128 being next to the primary channel 128 and the second secondary channel 130 being adjacent the front flange 122.

Each of the channels 126, 128 and 130 are of substantially V-shape in cross section with the primary channel 126 being separated from the first secondary channel 128 by an apex ridge 132 and the first and second secondary channels 128 and 130 being separated by an apex ridge 134. It will be noted that the apex ridge 132 is higher than the apex ridge 134 so that water overflowing, whether intentional or unintentional, will spill over the apex ridge 134 into the second secondary channel 130 prior to its reaching the height of the higher apex ridge 132 and causing a back flow condition.

A plurality of water outlet means 136 are formed in spaced increments in the bottom of each of the channel 126, 128 and 130, and each of the outlet means 136 is illustrated as being identical to the herinbefore fully described water outlet means 70 (FIG. 5). Therefore, each of the water outlet means 136 includes an aperture 136 having depending jagged edges 140 which surround the lower water outlet end of the aperture.

It will be understood that the water distribution trough 120 of this third embodiment of the present invention could be provided with either of the above described water outlet means 74 (FIG. 6), 84 (FIG. 7), instead of the illustrated outlet means 136.

Reference is made once again to FIG. 5 wherein a filter pad 150 is shown as being disposed in the upwardly open end of the trough 34. The pad 150, which may be made of spun glass or any suitable material of the type commonly used for filtration purposes, is sized so as to cover the entire length of the trough 34. The pad 150 will filter contaminating particles from the water and thereby help to further reduce the problems associated with water distribution troughs.

While the principles of the invention have now been made clear in the illustrated embodiments, there will be immediately obvious to those skilled in the art, many modifications of structure, arrangements, proportions, the elements, materials and components used in the practice of the invention, and otherwise, which are particularly adapted for specific environments and operation requirements without departing from those principles. The appended claims are therefore intended to cover and embrace any such modification within the limits only of the true spirit and scope of the invention.

What I claim is:

1. A cooler pad assembly for use in an evaporative cooler, said pad assembly comprising in combination:

(a) a frame defining an air inlet face and an air outlet face with a cavity therebetween;

(b) a wettable pad medium in the cavity defined by said frame: and (c) an elongated upwardly open water distribution trough mounted so as to extend across the upper end of said frame above said pad medium for receiving water from the plumbing system of the evaporative cooler and distributing it along the top of said pad medium for wetting thereof, said trough including, i. a front flange attached to the upper end of the air inlet face of said frame, ii. a rear flange spaced from and substantially parallel with said front flange and disposed proximate the air outlet face of said frame, iii. an elongated primary channel in the bottom of said trough proximate said rear flange, iv. at least one elongated secondary channel in the bottom of said trough and coextensive with said primary channel and disposed proximate said front flange, v. said primary and said secondary channels extending longitudinally in the bottom of said trough in a parallel side-by-side relationship and being separated by an upstanding ridge the top of which is lower than the tops of said front and rear flanges, said primary and said secondary channels each configured to define a plurality of water outlet means which are located in spaced increments in the bottoms thereof, vi. said primary channel being larger than said secondary channel to provide a larger water handling capability for accomplishing the normal water distribution functions of the evaporative cooler.

2. A cooler pad assembly as claimed in claim 1 wherein each of said water outlet means comprises an aperture formed in the bottom of said trough with jagged edges depending from the bottom of said trough in surrounding relationship with the lower end of the aperture.

3. A cooler pad assembly as claimed in claim 1 wherein each of said water outlet means comprises:

(a) an upwardly extending dimple formed in the bottom of said trough; and (b) said dimple defining an aperture which extends downwardly through said dimple from the crown thereof and has jagged edges depending from the underside of said dimple to surroundingly define the lower end of said aperture.

4. A cooler pad assembly as claimed in claim 1 wherein each of said water outlet means comprises a piece of tubing extending through the bottom of said trough and having an upper water inlet end disposed above the bottom of said trough and a lower water outlet end below the bottom of said trough.

5. A cooler pad assembly as claimed in claim 1 wherein said primary channel is of V-shape in cross section having a vertex along which some of said plurality of water outlet means are incrementally spaced.

6. A cooler pad assembly as claimed in claim 1 wherein said secondary channel of said trough is of V-shape in cross section having a vertex along which some of said plurality of water outlet means are incrementally spaced.

7. A cooler pad assembly as claimed in claim 1 wherein said primary channel is of truncated V-shaped cross section to provide a substantially flat bottom surface having some of said plurality of incrementally spaced water outlet means arranged in at least one row which extends longitudinally of the flat bottom surface of said primary channel.

8. A cooler pad assembly as claimed in claim 1 wherein said secondary channel is of truncated V-shaped cross section to provide a substantially flat bottom surface having some of said plurality of incrementally spaced water outlet means arranged in at least one row which extends longitudinally of the flat bottom surface of said secondary channel.

9. A cooler pad assembly as claimed in claim 1 wherein said trough is configured to provide a pair of said secondary channels with a first one of said pair of secondary channels being adjacent said primary channel and interposed between said primary channel and a second one of said pair of secondary channels.

10. A cooler pad assembly as claimed in claim 9 wherein said primary and said pair of secondary channels are sized so that said primary channel has the largest water handling capability, said first one of said pair of secondary channels has the second largest water handling capability and said second one of said pair of secondary channels having the smallest water handling capability.

11. A cooler pad assembly as claimed in claim 9 wherein said primary channel and said first one of said pair of secondary channels are separated by said upstanding ridge and said first one of said pair of secondary channels and said second one of said pair of secondary channels are separated by a second upstanding ridge the top of which is below the top of said first upstanding ridge.

12. A cooler pad assembly as claimed in claim 1 and further comprising filter means in said water distribution trough for filtering contaminating foreign particles from the water receivable therein.

* * * * *